United States Patent [19]

Altenweger

[11] 4,152,815

[45] May 8, 1979

[54] APPARATUS FOR DIVIDING WARPS WITH LEASES

[75] Inventor: Alois Altenweger, Uster, Switzerland

[73] Assignee: Zellweger Uster Ltd., Uster

[21] Appl. No.: 887,439

[22] Filed: Mar. 16, 1978

[30] Foreign Application Priority Data

Jun. 24, 1977 [CH] Switzerland ..... 7763/77

[51] Int. Cl.[2] ..... D02H 9/00

[52] U.S. Cl. ..... 28/198; 28/211

[58] Field of Search ..... 28/198, 199, 211

[56] References Cited

U.S. PATENT DOCUMENTS

| | | | |
|---|---|---|---|
| 2,011,115 | 8/1935 | Peterson | 28/211 |
| 3,378,899 | 4/1968 | Gronert | 28/211 |
| 3,432,897 | 3/1969 | Baumgartner | 28/198 |
| 3,879,824 | 4/1975 | Mizuno | 28/211 |

*Primary Examiner*—Henry Jaudon

*Attorney, Agent, or Firm*—Werner W. Kleeman

[57] ABSTRACT

An apparatus for dividing warp threads or ends by means of leases, comprising a first divider element or first divider means for separating a momentary edge thread from a sheet of warp threads or warp. The first divider element in conjunction with lease means, for instance constituted by lease cords, after separating a thread, changing its position relative to the sheet of warp threads in such a manner that all warp threads following the edge warp thread are displaced away therefrom. There is provided a second divider or separator element which is only capable of engaging a thread separated by the first divider element, possibly even a thread of a thread pair separated by the first divider element. The first divider element changes its position in a predetermined manner relative to the sheet of warp threads in dependency upon a programming device containing a program carrier.

10 Claims, 1 Drawing Figure

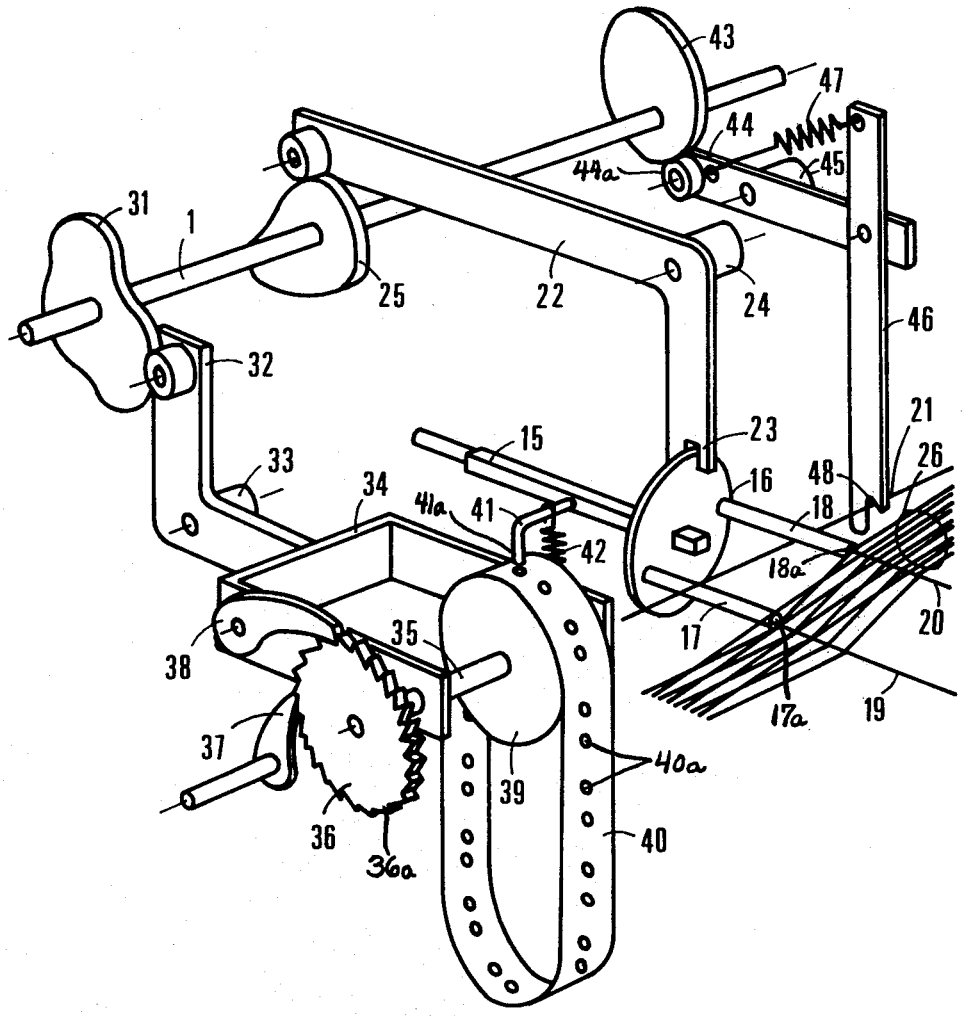
43
47
44
44a
45
31
1
25
22
24
46
32
21
23
15
26
33
16
48
34
41a
41
18
42
18a
20
38
35
17
17a
19
37
39
40a
36
40
36a

APPARATUS FOR DIVIDING WARPS WITH LEASES

BACKGROUND OF THE INVENTION

The present invention relates to a new and improved construction of apparatus for dividing or separating warp threads by means of leases.

There are already known to the art different constructions of apparatus for dividing or separating warp threads by means of leases, which incorporates divider or separator elements for the momentary edge warp thread and a thread feeder or feeder means for feeding the separated thread to tying elements or tying means. An exemplary embodiment of such equipment has been disclosed, for instance, in Swiss Pat. No. 348,937 to which reference may be readily had. Such embodies a control for rocking (raising and lowering) the lease cords which have been inserted through the sheet of warp threads or ends, which is fixedly coupled with the work cycle of the equipment. This means that the position of the lease cords is also then changed when there is prescribed a different sequence of the warp threads or ends which are to be separated. This is for instance the case when processing warp sheets having an uneven number of harness frames (irregular harness arrangement).

SUMMARY OF THE INVENTION

Hence, it is a primary object of the present invention to overcome these drawbacks and shortcomings of the prior art equipment and to satisfy the requirements presently existing in this art.

Another and more specific object of the present invention aims at the provision of a new and improved construction of apparatus for dividing or separating warp threads by means of leases, in a manner not associated with the drawbacks of the prior art equipment, and wherein the change of the position of a first divider element relative to the sheet of warp threads is controlled in a predetermined manner by means of a programming device.

Still a further significant object of the present invention resides in the provision of a new and improved construction of apparatus for separating warp threads by means of leases in an extremely reliable, efficient and accurate manner, which apparatus is relatively simple in construction and design, economical to manufacture, extremely reliable in operation, and not readily subject to breakdown or malfunction, and requires a minimum of maintenance and servicing.

Now in order to implement these and still further objects of the invention, which will become more readily apparent as the description proceeds, the apparatus of the present development for separating warp threads or ends by means of leases, comprises a first divider element, which may be of known construction, for separating the momentary edge warp thread from the sheet of warp threads or warp. This first divider element or divider means separates the edge warp thread out of the sheet of warp threads in that in conjunction with lease means, for instance in the form of lease cords, and following separation of a warp thread, such first divider element changes its position relative to the sheet of warp threads in such a manner that all warp threads following the edge warp thread are displaced away therefrom. There is additionally provided a second divider element, which also may be of known construction, which only can engage one thread separated by the first divider element, possibly even a thread of a thread pair separated by the first divider element. According to the invention the first divider element alters its position in a predetermined manner relative to the sheet of warp threads as a function of a program carrier.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates an exemplary embodiment of apparatus for separating warp threads by means of leases and constructed according to the teachings of the present invention.

DETAILED DESCRIPTION OF THE PREFERRED EMBODIMENTS

Describing now the drawing, there is illustrated therein an exemplary embodiment of apparatus for separating warp threads by means of leases, there having only been shown enough of the structure of the equipment to simplify the showing of the drawing and to enable those skilled in the art to readily understand the underlying principles and concepts of the present development. There will be seen a control shaft 1 which carries a number of cams or cam discs 25, 31 and 43 of equivalent structure, which control the dividing or separation of the edge warp thread 21 in accordance with a thread separation sequence which is determined by a programming device embodying a program carrier 40.

As above mentioned a first cam or cam disc 31 is seated upon the control shaft 1 and acts by means of angle lever 32, rotatably mounted at an angle lever support or bearing 33, upon a switching element, here shown in the form of a switching fork or bifurcated member 34 and imparts thereto an up-and-down motion. Mounted in the switching fork 34 is a switching or indexing shaft 35. This switching shaft 35 carries a ratchet wheel 36 and also a switching or indexing drum 39 or equivalent structure. The ratchet wheel or gear 36 is prevented from carrying out any reverse rotational movement by means of a holder pawl 38. During the up-and-down movement of the switching fork 34 it impacts against a stationary impact or indexing pawl 37, whereby the switching shaft 35 and together therewith the switching drum 39 are rotated through one division of the teeth **36*a* of the ratchet wheel 36 for each stroke of the switching fork 34, i.e. the switching drum 39 is indexed through one tooth division of the ratchet wheel 36 during each downward movement of the switching fork 34**.

The switching or indexing drum 39 can be constructed, for instance, as a support for programming device, here shown in the form of a perforated tape 40 constituting a program carrier in which there is stored the program for the separation of the edge warp threads 21 out of the warp end or warp thread sheet 26 by means of the punched-out holes or apertures **40*a* or equivalent structure. The switching drum 39** itself also however can be provided at its periphery with appropriate bores constituting the warp thread-divider program. This is especially then advantageous in those instances where the tooth division of the ratchet wheel 36 is adequate in order to accommodate a thread separation cycle at the switching drum 39.

As also previously mentioned, the control shaft 1 carries a further cam or cam disc 25 which pivots or rocks a displacement lever 22 rotatably mounted in a bearing or support 24. The bifurcated or forked end 23 of the displacement lever 22, located remote or opposite the cam 25, guides a disc 16 along a rotatable or pivotable rod 15 back-and-forth in the axial direction thereof. Mounted at the disc 16 are so-called lease tubes or hollow tubular members 17 and 18 which are oriented in axial direction and through the interior bores 17*a* and 18*a* of which there are guided lease means, here shown in the form of lease cords 19 and 20 respectively, for the sheet 26 of warp ends or threads. Mechanism not particularly shown in the drawing, to preserve clarity in illustration, imparts to the rotatable or pivotable rod 15 and together therewith the disc 16 mounted thereon a to-and-fro rocking or rotatable movement, whereby the lease cords 19 and 20 are alternately raised and lowered. One possible construction of mechanism suitable for this purpose has been disclosed in my commonly assigned, co-pending U.S. application Ser. No. 887,437, filed Mar. 16, 1978, entitled "Apparatus for Dividing Warps with Leases" to which reference may be readily had and the disclosure of which is incorporated herein by reference. As a result, each time the edge warp thread 21 is freed i.e. freely accessible, whereas the remaining warp threads of the sheet 26 of warp threads are pushed back by the tubes 17 and 18 owing to the back-and-forth movement of the disc 16 and therewith such tubes 17 and 18 and which motion is controlled by the displacement lever 22.

The tubes 17 and 18 thus constitute a first thread divider element or divider means for separating an edge warp thread.

Continuing, at the rotatable or pivotable rod 15 there is mounted a feeler pin 41 having a tip 41*a* which exactly fits into the control holes 40*a* of the program carrier 40 which moves below such feeler pin tip 41*a*. A spring 42 or equivalent structure provides the necessary feeling or scanning pressure. Upon lowering of the switching fork 34 the feeler pin 41 departs out of any control hole 40*a* of the program carrier 40 with which it previously engaged, and the switching drum 39 can further rotate or index. If the switching fork 34 again upwardly pivots then the feeler pin 41 either drops into the next hole 40*a* of the program carrier 40, or, however, if there is not present any hole, then such feeler pin 41 is upwardly entrained and the disc 16 is held in a position, in opposition to the pivotal command imparted by the remaining thread separation mechanism, where there cannot be separated any edge warp thread.

Finally, a further cam member or eccentric disc 43 which is mounted upon the control shaft 1 imparts an up-and-down movement to a divider or separation needle 46 or equivalent structure by means of a feeler lever 44 which is rotatably mounted in a feeler lever bearing or support 45. The feeler lever 44 bears by means of a follower roll 44*a* against the eccentric disc or cam 43. The second divider element constituted by the divider or separator needle 46 will be seen to possess at its lower end a calibrated notch 48 which is gaged to the diameter of the warp threads. A support spring 47 allows the divider needle 46 to bear against the separated warp thread 21, so that upon each depression or lowering of the divider needle 46 this edge warp thread 21 and only such can be downwardly urged, and therefore, delivered to not particularly illustrated but conventional tying or knotting elements.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for separating warp threads by means of leases, comprising:

a first divider element for separating an edge warp thread of a sheet or warp threads;

lease means cooperating with said warp threads;

said first divider element separating the edge warp thread out of the sheet of warp threads in conjunction with said lease means such that after separation of the edge warp thread said first divider element changes its position relative to the sheet of warp threads in such a manner that all threads following the edge warp thread are displaced away from said edge warp thread;

means for controlling operation of said first divider element;

a second divider element for engaging the thread separated by the first divider element;

means for controlling operation of said second divider element;

said controlling means for said first divider element comprising programming means for altering the position of the first divider element relative to the sheet of warp threads in a predetermined manner as a function of a program delivered by said programming means.

2. An apparatus for separating warp threads by means of leases, comprising:

a first divider element for separating an edge warp thread of a sheet of warp threads;

lease means cooperating with said warp threads;

said first divider element separating the edge warp thread out of the sheet of warp threads in conjunction with said lease means such that after separation of the edge warp thread said first divider element changes its position relative to the sheet of warp threads in such a manner that all threads following the edge warp thread are displaced away from said edge warp thread;

means for controlling operation of said first divider element;

a second divider element for engaging the thread separated by the first divider element;

means for controlling operation of said second divider element;

said controlling means for said first divider element comprising programming means for altering the position of the first divider element relative to the sheet of warp threads in a predetermined manner as a function of a program delivered by said programming means;

said lease means comprising lease cords;

said first divider element comprising lease tubes through a respective one of each of which there extends one of said lease cords;

disc means supporting said lease tubes; and said disc means being selectively movable or retainable in a given position in response to operation of said feeler pin.

3. The apparatus as defined in claim 2, wherein: said programming means incorporates a program carrier.

4. The apparatus as defined in claim 2, wherein: said second divider element is capable of engaging a thread of a pair of threads which have been separated from the sheet of warp threads by the first divider element.

5. The apparatus as defined in claim 2, wherein:

said programming means comprises a program carrier having control holes;

said means for controlling operation of said first divider element comprising:

means for stepwise indexing said program carrier;

a feeler pin for scanning the stepwise indexed program carrier for the presence or absence of a control hole.

6. The apparatus as defined in claim 2, wherein:

said programming means comprises a program carrier;

said means for controlling operation of said first divider element comprises:

indexable ratchet means for imparting selective movements to said program carrier.

7. The apparatus as defined in claim 6, wherein:

said ratchet means comprises a pawl and ratchet wheel.

8. The apparatus as defined in claim 2, wherein:

said second divider element comprises a divider needle capable of presenting the separated edge warp thread to tying means.

9. An apparatus for separating warp threads by means of leases, comprising:

a first divider element for separating an edge warp thread of a sheet of warp threads;

lease means cooperating with said warp threads;

said first divider element separating the edge warp thread out of the sheet of warp threads in conjunction with said lease means such that after separation of the edge warp thread said first divider element changes its position relative to the sheet of warp threads in such a manner that all threads following the edge warp thread are displaced away from said edge warp thread;

means for controlling operation of said first divider element;

a second divider element for engaging the thread separated by the first divider element;

means for controlling operation of said second divider element;

said controlling means for said first divider element comprising programming means for altering the position of the first divider element relative to the sheet of warp threads in a predetermined manner as a function of a program delivered by said programming means;

said programming means comprising a program carrier having control holes;

said means for controlling operation of said first divider element comprising means for stepwise indexing said program carrier and a feeler pin for scanning the stepwise indexed program carrier for the presence or absence of a control hole;

said lease means comprising lease cords;

said first divider element comprising lease tubes through a respective one of each of which there extends one of said lease cords;

disc means supporting said lease tubes; and said disc means being selectively movable or retainable in a given position in response to operation of said feeler pin.

10. The apparatus as defined in claim 9, wherein:

said means for controlling operation of said first divider element comprises means for axially displacing said disc meeans in order to shift the warp threads of the warp thread sheet which have not been separated out of a warp thread-separation zone.

* * * * *